US008644544B2

(12) United States Patent
Akino

(10) Patent No.: US 8,644,544 B2
(45) Date of Patent: Feb. 4, 2014

(54) DYNAMIC MICROPHONE UNIT AND DYNAMIC MICROPHONE

(75) Inventor: Hiroshi Akino, Kanagawa (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 13/599,434

(22) Filed: Aug. 30, 2012

(65) Prior Publication Data

US 2013/0058514 A1 Mar. 7, 2013

(30) Foreign Application Priority Data

Sep. 1, 2011 (JP) ..... 2011-190566

(51) Int. Cl.
*H04R 1/20* (2006.01)
*H04R 25/00* (2006.01)

(52) U.S. Cl.
USPC ..... 381/346; 381/150; 381/355; 381/179

(58) Field of Classification Search
USPC ..... 381/150, 162, 179, 345–348, 353, 355, 381/369
See application file for complete search history.

(56) References Cited

FOREIGN PATENT DOCUMENTS

JP 2007-300267 11/2007
JP 2011-014990 1/2011

*Primary Examiner* — Brian Ensey
*Assistant Examiner* — Sabrina Diaz
(74) *Attorney, Agent, or Firm* — Whitham, Curtis, Christofferson & Cook, P.C.

(57) ABSTRACT

A dynamic microphone unit includes a diaphragm vibrating in response to received sound waves; a voice coil fixed to the diaphragm; a magnetic circuit generating magnetism in a magnetic gap where the voice coil is disposed; and an acoustic resistor disposed in a space adjacent to the reverse of the diaphragm. The acoustic resistor includes a cover disposed between a felt and the diaphragm. A case having an open end and a closed end accommodates the felt and the cover. The cover has holes transmitting sound waves at the closed end and a bending portion at the open end which urges the cover and the felt.

10 Claims, 7 Drawing Sheets

DYNAMIC MICROPHONE UNIT AND DYNAMIC MICROPHONE

TECHNICAL FIELD

The present invention relates to a dynamic microphone unit and a dynamic microphone, and in particular, to a structure of an acoustic resistor behind a diaphragm.

BACKGROUND ART

Omnidirectional components of a unidirectional dynamic microphone are controlled by resistance (resistance control). Bidirectional components of a unidirectional dynamic microphone are controlled by mass (mass control). In order to obtain omnidirectional components, the dynamic microphone includes an acoustic resistor disposed immediately behind a diaphragm, which leads to flat frequency responses of resistance components.

FIG. 6 is a longitudinal cross-sectional view of a typical related dynamic microphone unit. As illustrated in FIG. 6, a unit case 1 functions as a base of the microphone unit 200. The unit case 1 is composed of a magnetic material. The unit case 1 serves as an outer yoke, and as an inner yoke 2, which will be described below. The unit case 1 functions as a part of a magnetic circuit. The unit case 1 is a cylindrical member having open ends, and is provided with a step 12 on an inner circumference in the middle of the vertical direction. A space above the step 12 corresponds to an air chamber 9, while a space below the step 12 corresponds to an air chamber 11.

The air chamber 9 in the unit case 1 accommodates a magnetic circuit composed of the following magnetic circuit components.

A disk inner yoke 2 fixed into the air chamber 9 is in contact with the step 12 of the unit case 1, which defines the position of the inner yoke 2 in the vertical direction. The outer circumferential surface of the inner yoke 2 is in contact with the inner circumferential surface of the unit case 1.

A disk magnet 3 fixed upon the inner yoke 2 has a smaller outer diameter than the inner diameter of the air chamber 9 in the unit case 1. A disk pole piece 4 is fixed upon the magnet 3. The magnet 3, the inner yoke 2, the unit case 1, and the pole piece 4 are the magnetic circuit components. The top surface of the pole piece 4 is substantially flush with the top surface of the unit case 1. The outer circumferential surface of the pole piece 4 faces the inner circumferential surface of the top portion of the unit case 1 with a proper gap to define a circular magnetic gap.

The magnet 3 generates a magnetic flux returning to the magnet 3 through a magnetic circuit composed of the inner yoke 2, the unit case 1, the magnetic gap, and the pole piece 4. In other words, the magnetic flux traverses the magnetic gap. The outer circumferential surface of the magnet 3 and the inner circumferential surface of the unit case 1 define an air chamber 9 below the magnetic gap, the air chamber 9 having a larger width than that of the magnetic gap. The pole piece 4, the magnet 3, and the inner yoke 2 respectively have center holes 41, 31, and 21 having the same diameter. The center holes 41, 31, and 21 are in communication with the air chamber 11 defined in a substantially bottom half of the unit case 1.

The outer circumferential surface of the top portion of the unit case 1 is fixed to a cylindrical member 35 composed of a nonmagnetic material. The cylindrical member 35 has a projection edge 36 along the inner circumferential surface at the top. The projection edge 36 is fixed to the outer circumferential surface of the top portion of the unit case 1.

The projection edge 36 of the cylindrical member 35 has a plurality of vertical through holes 37. The holes 37 are covered by a thin-sheet acoustic resistor 18 fixed on the top of the projection edge 36.

The outer circumferential surface of the unit case 1 and the inner circumferential surface of the cylindrical member 35 define a circular space 38 below the projection edge 36. The space 38 is in communication with a space behind a sub dome 52 of a diaphragm 5, which will be described below, through the acoustic resistor 18 and the holes 37.

The cylindrical member 35 has a projection edge 14 along the outer circumferential surface at the top. The cylindrical member 35 also has a concentric projection 13 inside the projection edge 14, the projection 13 having a height lower than the projection edge 14. The top surface of the projection 13 is fixed to the outer peripheral edge of a diaphragm 5. The diaphragm 5 is a thin film composed of a material such as synthetic resin or metal. The diaphragm 5 includes a center dome 51 and a sub-dome 52 surrounding the center dome 51 that are produced by shaping a thin film of a synthetic resin or metal.

The center dome 51 is a partial spherical shell. The sub-dome 52 has a partially arc-shaped cross section and extends along the peripheral edge of the center dome 51. The outer peripheral edge of the sub-dome 52 is fixed on the top surface of the projection 13.

The diaphragm 5 is fixed at its outer peripheral edge of the sub-dome 52 on the top surface of the projection 13 as described above. This enables the diaphragm 5 to vibrate in response to sound pressure from received sound waves, in the anteroposterior direction (the vertical direction in FIG. 6) around the outer peripheral edge of the sub-dome 52 as a supporting node.

A voice coil 6 is fixed along a circular boundary line between the center dome 51 and the sub-dome 52 in the diaphragm 5. The voice coil 6 is formed by winding a fine conductive wire and by fixing it into a cylindrical shape. One end of the cylindrical voice coil 6 is fixed to the diaphragm 5. The voice coil 6 is disposed in the magnetic gap while the outer peripheral edge of the sub-dome 52 in the diaphragm 5 is fixed to the diaphragm 5 as described above. In this state, the voice coil 6 is separated from both the unit case 1 and the pole piece 4.

A protector 7 for the diaphragm 5 is fixed on the top surface of the pole piece 4. The top portion of the protector 7 has a partially spherical shape or a dome shape similarly to the center dome 51 of the diaphragm 5. The protector 7 faces the reverse of the center dome 51 having a certain distance therebetween.

The protector 7 limits the vibration of excessive amplitude of the diaphragm 5, which prevents the diaphragm 5 and the voice coil 6 integrated to the diaphragm 5 from being damaged.

The protector 7 also has a center hole 71. A space adjacent to the reverse of the center dome 51 is in communication with the air chamber 11 through the center hole 71 and the center holes 41, 31, and 21 of the pole piece 4, the magnet 3, and the inner yoke 2 respectively, the center holes 41, 31, 21 having the same diameter.

Adjacent to the obverse of the diaphragm 5, an equalizer 8 serving also as a protector for the diaphragm 5 is fixed, at its peripheral edge, to the projection edge 14 of the unit case 1. The equalizer 8 has a ceiling surface having a dome shape in the center. The ceiling surface in the center of the equalizer 8 keeps a predetermined distance from the center dome 51 of the diaphragm 5. The equalizer 8 has a plurality of holes 82 for transmitting sound waves from the exterior to the diaphragm 5.

The bottom end of the unit case 1 is closed by a cap 10 to define a relatively large air chamber 11 in the unit case 1. In the air chamber 11, an acoustic resistor 16 adheres to the bottom surface of the yoke 2. The inner circumference of the air chamber 11 of the unit case 1 supports the outer circumference of the acoustic resistor 16. The acoustic resistor 16 is composed of, for example, a thickly-layered unwoven fabric. The acoustic resistor 16 is disposed in a space adjacent to the reverse of the diaphragm 5. The space adjacent to the reverse of the diaphragm 5 is closed by the cap 10 to define the relatively large air chamber 11 adjacent to the reverse of the diaphragm 5, as described above.

The diaphragm 5 vibrates in the anteroposterior direction in response to a variation in the sound pressure from received sound waves. The voice coil 6 also vibrates in the anteroposterior direction in cooperation with the diaphragm 5. The vibrating voice coil 6 traverses the magnetic flux extending through the magnetic gap. The voice coil 6 traversing the magnetic flux generates electric power as audio signals in response to a variation in the sound pressure. The dynamic microphone unit 200 electro-acoustically converts the signals as described above. For example, audio signals are outputted from the both ends of the voice coil 6 wound along the reverse of the sub-dome 52 to the exterior.

In the dynamic microphone unit 200 such a configuration, the acoustic resistor 16 in the space adjacent to the reverse of the diaphragm 5 provides an acoustic resistance to generate the omnidirectional components described above. Any materials such as an unwoven fabric, a resin mesh, sponge, or a felt can be used for the acoustic resistor 16. Particularly, a felt is preferable for the acoustic resistor to generate an omnidirectional component. A felt has a relatively high acoustic resistance density, and thus can have a relatively large volume. The felt, therefore, tends to readily absorb sound waves.

FIG. 7 is a graph representing observed acoustic absorption of a felt. As a frequency increases, the acoustic absorption of the felt increases and exhibits a peak around 2000 KHz. The felt having such characteristics as described above is used for the acoustic resistor to generate an omnidirectional component of the dynamic microphone, which can effectively prevent a resonance due to the space adjacent to the reverse of the diaphragm 5.

Felt is made of primarily compressed animal fibers. The fibers easily fall off from the surface of the felt. The dynamic microphone including the acoustic resistor made of such a felt has a problem in that the fibers, which have fall off from the surface of the acoustic resistor of a felt, intrude into, for example, the magnetic gap. The intruded fibers remain on the voice coil in the magnetic gap. The fibers remaining on the voice coil inhibits the movement of the voice coil, which results in unsatisfactory acoustic characteristics of the microphone.

When the acoustic resistor 16 made of an elastic material such as a felt is fixed to the microphone unit component (to the inner circumferential surface of the unit case 1 in FIG. 6), a gap may be defined between them. The gap transmits sound waves as shown by the arrow in FIG. 6. In this case, the acoustic resistor 16 fails to serve as an acoustic resistance, and causing the malfunction of the dynamic microphone.

A possible countermeasure to the problem is sealing the contact point between the edge of the felt as an acoustic resistor 16 and the unit component supporting the edge using a sealing material 17 such as a sealant as shown in FIG. 6.

This countermeasure cannot efficiently provide an acoustic resistor having a flat acoustic resistance because the felt is made of primarily compressed animal fibers as described above.

Another possible countermeasure to the problem is adjustment of the compression degree of the felt using, for example, a screw in order to produce an acoustic resistor having an adjustable acoustic resistance. Such an acoustic resistor, however, requires a complex structure and complicated manufacturing process that involve individual adjustments of the acoustic resistances of individual acoustic resistors.

The dynamic microphone including the acoustic resistor in the space adjacent to the reverse of the diaphragm is described in Japanese Unexamined Patent Application Publication Nos. 2011-14990 and 2007-300267.

SUMMARY OF INVENTION

Technical Problem

An object of the present invention is to provide a dynamic microphone unit that can achieve satisfactory acoustic characteristics of a microphone and to provide a dynamic microphone including the dynamic microphone unit.

Solution to Problem

A dynamic microphone unit according to the present invention includes: a diaphragm vibrating in response to received sound waves; a voice coil fixed to the diaphragm and vibrating in cooperation with the diaphragm; a magnetic circuit generating magnetism in a magnetic gap, the voice coil being disposed in the magnetic gap; and an acoustic resistor disposed in a space adjacent to the reverse of the diaphragm, wherein the acoustic resistor includes:

a felt;

a cover comprising a material transmitting sound waves, the cover being disposed between the felt and the diaphragm; and an acoustic resistor case having an open end and a closed end, the acoustic resistor case accommodating the felt and the cover, the acoustic resistor case having holes transmitting sound waves at the closed end and having a bending portion at the open end, the cover and the felt being urged by the bending portion.

DESCRIPTION OF EMBODIMENTS

Figure 6:
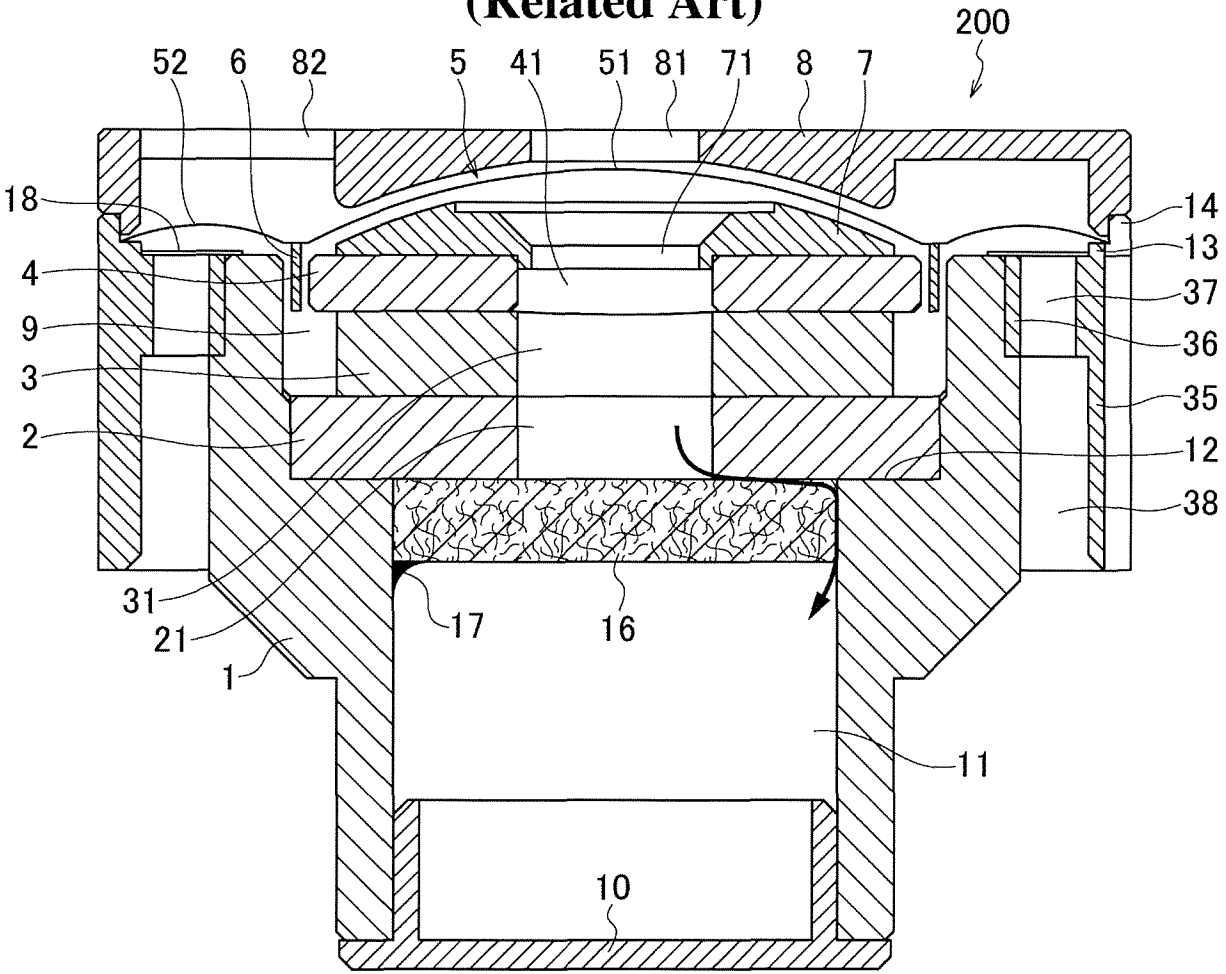
FIG. 6 (Related Art)
FIG. 6 is a longitudinal cross-sectional view of a typical related dynamic microphone unit.
Figure 7:
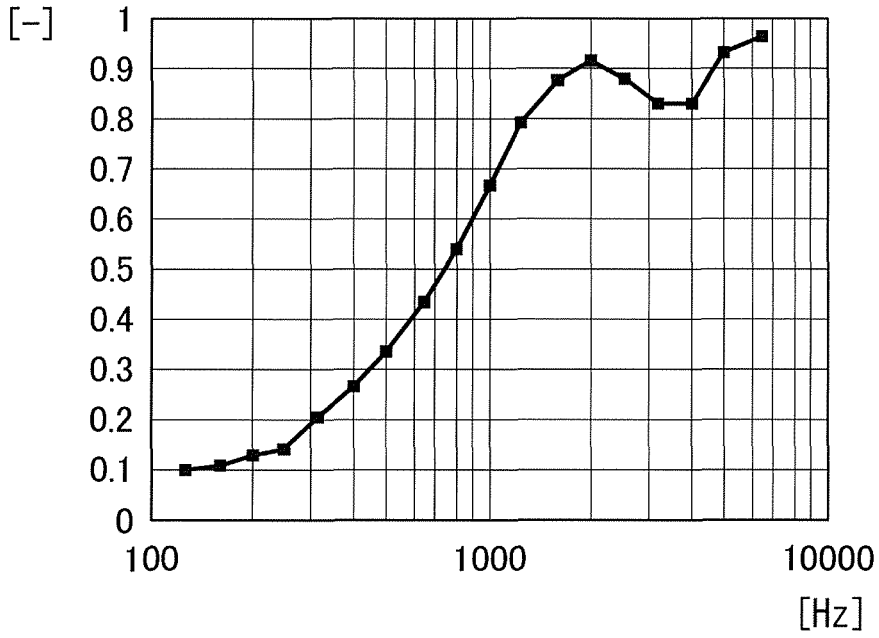
FIG. 7 is a characteristic diagram representing the dependence of the absorption of the acoustic resistor composed of a felt on acoustic frequencies.

A dynamic microphone unit according to an embodiment of the present invention will now be described with reference to the accompanying drawings. A dynamic microphone according to the present invention will also be described. The same reference numerals are assigned to the same elements as those of the related dynamic microphone unit illustrated in FIG. 6.

Embodiments

Figure 1:
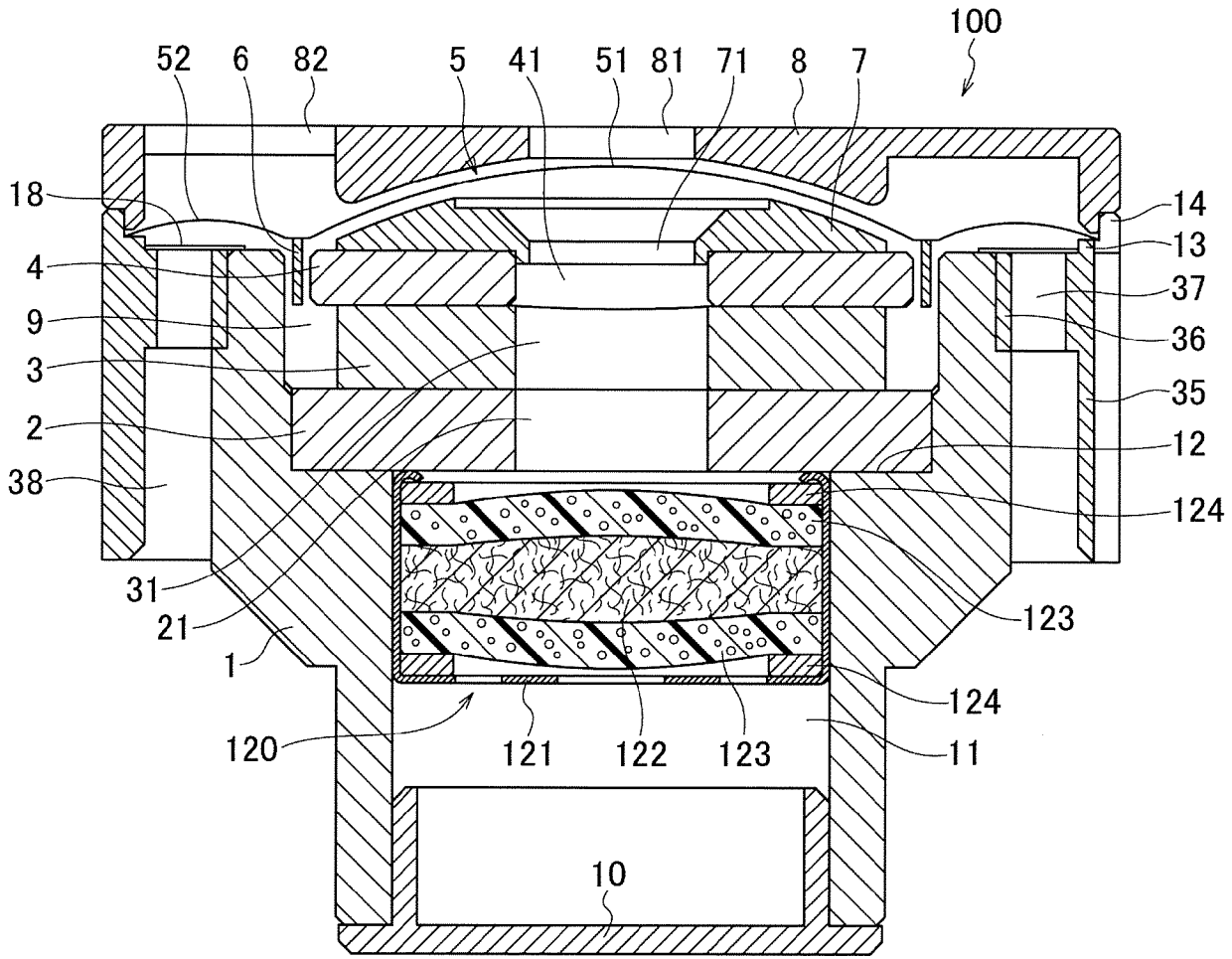
FIG. 1 is a longitudinal cross-sectional view of a typical dynamic microphone unit according to an embodiment of the present invention.

FIG. 1 illustrates a unit case 1 as a base of the dynamic microphone unit 100. The unit case 1 composed of a magnetic material serves as an outer yoke, and as an inner yoke, which will be described below. The unit case 1 functions as a part of a magnetic circuit. The unit case 1 is a cylinder having open ends, and is provided with a step 12 on an inner circumference in the middle of the vertical direction. A space above the step 12 corresponds to an air chamber 9, while a space below the step 12 corresponds to an air chamber 11.

The air chamber 9 in the unit case 1 accommodates a magnetic circuit composed of the following magnetic circuit components.

A disk inner yoke 2 fixed into the air chamber 9 is in contact with the step 12 of the unit case 1, which defines the position of the inner yoke 2 in the vertical direction. The outer circumferential surface of the inner yoke 2 is in contact with the inner circumferential surface of the unit case 1.

A disk magnet 3 fixed upon the inner yoke 2 has a smaller outer diameter than the inner diameter of the air chamber 9 in the unit case 1.

A disk pole piece 4 is fixed upon the magnet 3. The magnet 3, the inner yoke 2, the unit case 1, and the pole piece 4 are the magnetic circuit components. The top surface of the pole piece 4 is substantially flush with the top surface of the unit case 1.

The outer circumferential surface of the pole piece 4 faces the inner circumferential surface of the top portion of the unit case 1 with a proper gap to define a circular magnetic gap.

The magnet 3 generates a magnetic flux returning to the magnet 3 through a magnetic circuit composed of the inner yoke 2, the unit case 1, the magnetic gap, and the pole piece 4. In other words, the magnetic flux traverses the magnetic gap. The outer circumferential surface of the magnet 3 and the inner circumferential surface of the unit case 1 define an air chamber 9 having a larger width than that of the magnetic gap below the magnetic gap. The pole piece 4, the magnet 3, and the inner yoke 2 respectively have center holes 41, 31, and 21 having the same diameter. The center holes 41, 31, and 21 are in communication with the air chamber 11 defined in a substantially bottom half of the unit case 1.

The outer circumferential surface of the top portion of the unit case 1 is fixed to a cylindrical member 35 composed of a nonmagnetic material. The cylindrical member 35 has a projection edge 36 along the inner circumferential surface at the top. The projection edge 36 is fixed to the outer circumferential surface of the top portion of the unit case 1.

The projection edge 36 of the cylindrical member 35 has a plurality of vertical through holes 37. The holes 37 are covered by a thin-sheet acoustic resistor 18 fixed on the top of the projection edge 36. The outer circumferential surface of the unit case 1 and the inner circumferential surface of the cylindrical member 35 define a circular space 38 below the projection edge 36. The space 38 is in communication with a space behind a sub dome 52 of a diaphragm 5, which will be described below, through the acoustic resistor 18 and the holes 37.

The cylindrical member 35 has a projection edge 14 along the outer circumferential surface at the top. The cylindrical member 35 also has a concentric projection 13 inside the projection edge 14, the projection 13 having a height lower than the projection edge 14. The top surface of the projection 13 is fixed to the outer peripheral edge of a diaphragm 5. The diaphragm 5 is a thin film composed of a material such as synthetic resin or metal. The diaphragm 5 includes a center dome 51 and a sub-dome 52 surrounding the center dome 51 that are produced by shaping a thin film of a synthetic resin or metal.

The center dome 51 is a partial spherical shell. The sub-dome 52 has a partially arc-shaped cross section and extends along the peripheral edge of the center dome 51. The outer peripheral edge of the sub-dome 52 is fixed on the top surface of the projection 13.

The diaphragm 5 is fixed at its outer peripheral edge of the sub-dome 52 on the top surface of the projection 13 as described above. This enables the diaphragm 5 to vibrate in response to sound pressure from received sound waves, in the anteroposterior direction (the vertical direction in FIG. 1) around the outer peripheral edge of the sub-dome 52 as a supporting node.

A voice coil 6 is fixed along a circular boundary line between the center dome 51 and the sub-dome 52 in the diaphragm 5. The voice coil 6 is formed by winding a fine conductive wire and by fixing it into a cylindrical shape. One end of the cylindrical voice coil 6 is fixed to the diaphragm 5. The voice coil 6 is disposed in the magnetic gap while the outer peripheral edge of the sub-dome 52 in the diaphragm 5 is fixed to the diaphragm 5 as described above. In this state, the voice coil 6 is separated from both the unit case 1 and the pole piece 4.

A protector 7 for the diaphragm 5 is fixed on the top surface of the pole piece 4. The top portion of the protector 7 has a partially spherical shape or a dome shape similarly to the center dome 51 of the diaphragm 5. The protector 7 faces the reverse of the center dome 51 having a certain distance therebetween.

The protector 7 limits the vibration of excessive amplitude of the diaphragm 5, which prevents the diaphragm 5 and the voice coil 6 integrated to the diaphragm 5 from being damaged.

The protector 7 also has a center hole 71. A space adjacent to the reverse of the center dome 51 is in communication with the air chamber 11 through the center hole 71 and the center holes 41, 31, and 21 of the pole piece 4, the magnet 3, and the inner yoke 2 respectively, the center holes 41, 31, 21 having the same diameter.

Adjacent to the obverse of the diaphragm 5, an equalizer 8 serving also as a protector for the diaphragm 5 is fixed, at its peripheral edge, to the projection edge 14 of the unit case 1. The equalizer 8 has a ceiling surface having a dome shape in the center. The ceiling surface in the center of the equalizer 8 keeps a predetermined distance from the center dome 51 of the diaphragm 5. The equalizer 8 has a plurality of holes 82 for transmitting sound waves from the exterior to the diaphragm 5.

The bottom end of the unit case 1 is closed by a cap 10 to define a relatively large air chamber 11 in the unit case 1. The air chamber 11 is in communication with the center holes 21, 31, 41, and 71 of the inner yoke 2, the magnet 3, the pole piece 4, and the protector 7, respectively, and the space between the diaphragm 5 and the protector 7. These communicating spaces are adjacent to the reverse of the diaphragm 5. The space adjacent to the reverse of the diaphragm 5 has an acoustic resistor 120 disposed therein. The acoustic resistor 120 will now be described in detail with reference to FIGS. 2 to 5

Figure 2:
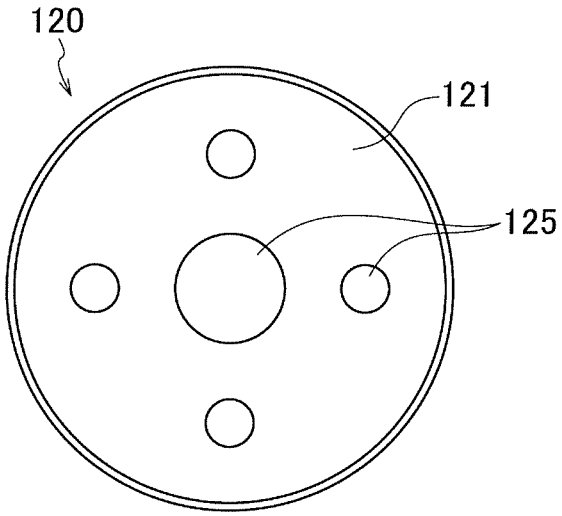
FIG. 2 is a bottom view of an acoustic resistor in the embodiment.
Figure 3:
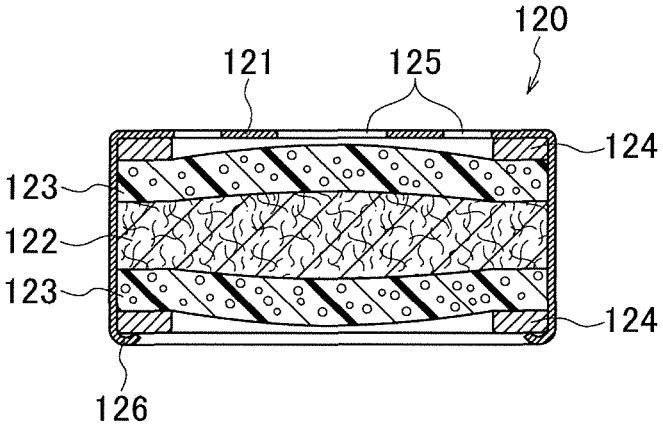
FIG. 3 is a longitudinal cross-sectional view of the acoustic resistor.

In FIGS. 1 to 3, the acoustic resistor 120 includes a felt 122 as a primary element. Both surfaces of the felt 122 are covered by covers 123 composed of a material which can transmit sound waves. One of the covers 123 is disposed between the felt 122 and the diaphragm 5. The other cover 123 is disposed between the felt 122 and the bottom of the acoustic resistor case 121. Ring holders 124 are disposed along the peripheral edges of the covers 123. The acoustic resistor 120 includes an acoustic resistor case 121 accommodating the felt 122, the covers 123, and the holders 124.

The acoustic resistor case 121 is a cylindrical member having a closed end and composed of a thin plate of, for example, metal. The acoustic resistor case 121 has a plurality of holes 125 transmitting sound waves at the bottom.

The peripheral edge of the open end of the acoustic resistor case 121, which accommodates the elements described above, is bent inward to form a bending portion 126. The bending portion 126 urges the peripheral edges of the elements such that these elements are accommodated in the acoustic resistor case 121.

The felt 122 has a predetermined thickness to provide a proper acoustic resistance and acoustic absorption. As compared with the felt 122, the cover 123 is composed of a material such as a mesh or sponge having a lower acoustic resistance and readily transmitting sound waves. The covers 123 prevent the fibers of the felt 122 from falling from the surfaces of the felt 122. The holders 124 may be composed of any material such as metal or plastic. The covers 123 covering each surface of the felt 122 are held at the peripheral edges by the holders 124. One of the holders 124 is in contact with the bottom of the acoustic resistor case 121. The other holder 124 is urged by the bending portion 126 of the acoustic resistor case 121.

Figure 4:
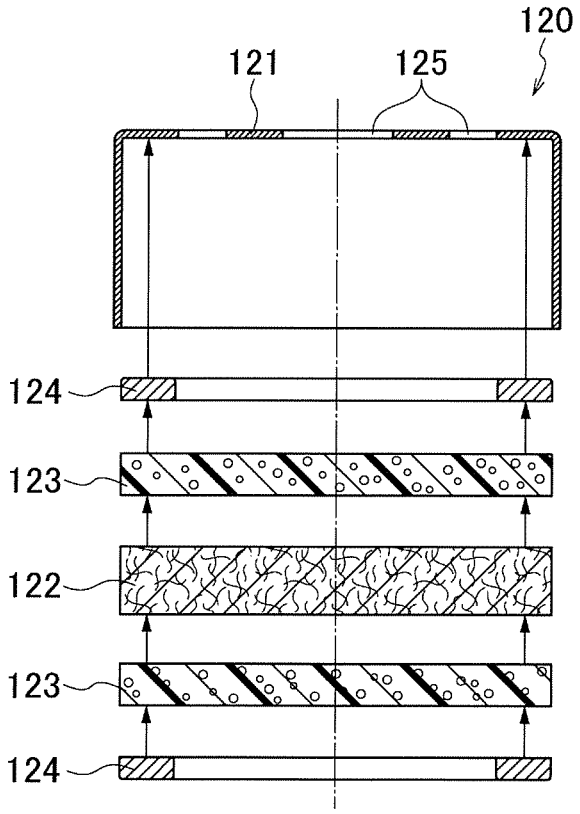
FIG. 4 is an exploded longitudinal cross-sectional view illustrating elements of the acoustic resistor.
Figure 5:
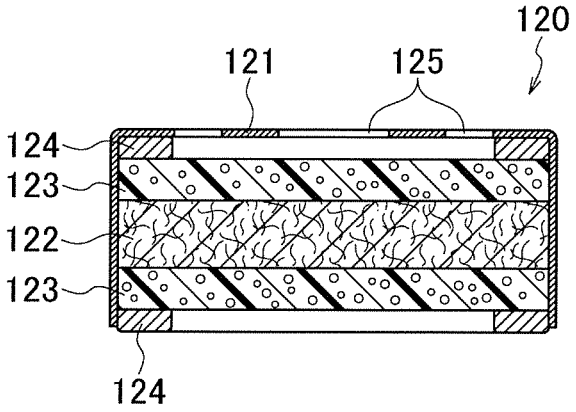
FIG. 5 is a longitudinal cross-sectional view of the acoustic resistor in a typical assembling process.

FIG. 4 illustrates the elements before being accommodated into the acoustic resistor case 121. FIG. 5 illustrates the elements accommodated in the acoustic resistor case 121, the peripheral edge of the acoustic resistor case 121 not yet having the bending portion 126.

The bending portion 126 is fanned by urging the holder 124 disposed at the open end of the acoustic resistor case 121 toward the bottom plate of the acoustic resistor case 121 with, for example, a jig. Pressure by the holder 124 is vertically applied through the cover 123 onto both surfaces of the felt 122.

The pressure applied to the peripheral edge of the felt 122 gradually reduces toward the center of the felt 122. As a result, the density of the felt 122 gradually decreases from the periphery to the center. The acoustic resistance of the felt 122 gradually reduces from the peripheral edge to the center.

The acoustic resistance of the acoustic resistor 120 substantially depends on the acoustic resistance of the felt 122. The acoustic resistance of the felt 122 depends on the pressure applied vertically to both surfaces of the felt 122. The pressure applied to both surfaces of the felt 122 depends on a degree of bending of the bending portion 126 of the acoustic resistor case 121.

The degree of the bending portion 126 can be predetermined during the design stage of the acoustic resistor 120. During the assembly of the elements into the acoustic resistor 120, the bending portion 126 is bent as designed to provide the acoustic resistor 120 having substantially no variations in acoustic resistances.

The outer circumferential surface of the acoustic resistor case 121 is in contact with the inner circumferential surface of the unit case 1 such that the acoustic resistor 120 assembled as described above is disposed in the air chamber 11 in the unit case 1. The air chamber 11 is a space adjacent to the reverse of the diaphragm 5 in which the acoustic resistor 120 is disposed. The dynamic microphone unit 100 having such a configuration can provide omnidirectional components, and can achieve unidirectionality.

The diaphragm 5 vibrates in the anteroposterior direction in response to a variation in the sound pressure from received sound waves. The voice coil 6 also vibrates in the anteroposterior direction in cooperation with the diaphragm 5. The vibrating voice coil 6 traverses the magnetic flux extending through the magnetic gap. The voice coil 6 traversing the magnetic flux generates electric signals in response to a variation in the sound pressure. The electric signals correspond to acoustic signals. The dynamic microphone unit 100 electroacoustically converts the signals as described above. For example, audio signals are outputted from both ends of the voice coil 6 wound along the reverse of the sub-dome 52 to the exterior.

According to the embodiment described above, the acoustic resistor 120 disposed in the space adjacent to the reverse of the diaphragm 5 in order to obtain the omnidirectional components includes the felt 122, the covers 123 covering each surface of the felt 122, the ring holders 124, and the acoustic resistor case 121 accommodating the felt 122, the covers 123, and the ring holders 124. The peripheral edge of the cover 123 is urged by the bending portion 126 formed at the open end of the acoustic resistor case 121 through the ring holder 124. In such a configuration, the cover 123 prevents the fibers of the felt 122 from falling off, the felt 122 being the primary element of the acoustic resistor. The peripheral edges of the covers 123 urged by the holder 124 can solve the technical disadvantages, i.e., unsatisfactory characteristics of a dynamic microphone unit caused by the fibers intruded in a magnetic gap.

Furthermore, according to the embodiment described above, a desired acoustic resistance can be obtained by determining an appropriate degree of bending of the bending portion 126 of the acoustic resistor case 121 without involving the alternation of the configuration of the acoustic resistor 120. Additionally, according to the embodiment described above, the degree of bending of the bending portion 126 can be determined in accordance with the design specification, which can easily produce the acoustic resistor 120 having an acoustic resistor providing few variations in an acoustic resistance.

Furthermore, according to the embodiment described above, the acoustic resistor case 121 includes two covers. However, in this invention, it is enough that the acoustic resistor case 121 includes only one cover disposed between the felt 122 and the diaphragm 5. In addition, according to the embodiment described in FIG. 1, the acoustic resistor case 121 is disposed in the unit case 1 in the direction where the open end of the acoustic resistor case 121 faces to the diaphragm 5. However, in this invention, the acoustic resistor case 121 may be disposed in the unit case 1 in the direction where the bottom of the acoustic resister case 121 faces to the diaphragm 5.

A dynamic microphone includes the dynamic microphone unit according to the embodiment described above and a microphone case accommodating the dynamic microphone unit, the microphone case having a microphone connector for transmitting output signals to the outside.

What is claimed is:

1. A dynamic microphone unit comprising:

a diaphragm vibrating in response to received sound waves;

a voice coil fixed to the diaphragm and vibrating in cooperation with the diaphragm;

a magnetic circuit generating magnetism in a magnetic gap, the voice coil being disposed in the magnetic gap; and an acoustic resistor disposed in a space adjacent to the reverse of the diaphragm, the acoustic resistor comprising:

a felt;

a cover comprising a material transmitting sound waves, the cover being disposed between the felt and the diaphragm; and an acoustic resistor case having an open end and a closed end, the acoustic resistor case accommodating the felt and the cover, the acoustic resistor case having holes transmitting sound waves at the closed end and having a bending portion at the open end, the cover and the felt being urged by the bending portion.

2. The dynamic microphone unit according to claim 1, wherein the acoustic resistor case is adjacent to the diaphragm at the open end, and accommodates the cover and the felt disposed in sequence from the open end toward the closed end;

the bending portion urges a peripheral edge of the cover accommodated in the acoustic resistor case; and the felt accommodated in the acoustic resistor is urged by the bending portion through the cover.

3. The dynamic microphone unit according to claim 1, further comprising another cover wherein the acoustic resistor case accommodates the cover, the other cover, and the felt disposed between the cover and the other cover.

4. The dynamic microphone unit according to claim 3, wherein ring acoustic resistor holders are disposed on the covers;

one of the ring acoustic resistor holders is in contact with a bottom of the acoustic resistor case; and the other ring acoustic resistor holder is urged by the bending portion.

5. The dynamic microphone unit according to claim 1, wherein a pressure applied to a peripheral edge of the felt gradually reduces towards the center of the felt.

6. The dynamic microphone unit according to claim 1, wherein the bending portion adjusts a pressure applied to the felt.

7. The dynamic microphone unit according to claim 4, wherein a pressure applied to the felt is adjusted according to a degree of bending of the bending portion.

8. The dynamic microphone unit according to claim 1, wherein the cover comprises a material having a lower acoustic resistance than the acoustic resistance of the felt.

9. The dynamic microphone unit according to claim 1, the dynamic microphone unit including a unit case accommodating components including the diaphragm and the magnetic circuit, wherein the unit case comprises an air chamber;

the outer circumferential wall of the acoustic resistor case is in contact with the inner circumferential wall of the air chamber such that the acoustic resistor is disposed in the air chamber.

10. A dynamic microphone comprising the dynamic microphone unit according to claim 1 and a microphone case accommodating the dynamic microphone unit.

* * * * *